US010208366B2

(12) United States Patent
Olsen et al.

(10) Patent No.: US 10,208,366 B2
(45) Date of Patent: Feb. 19, 2019

(54) METAL-MATRIX COMPOSITES REINFORCED WITH A REFRACTORY METAL

(71) Applicant: Halliburton Energy Services, Inc., Houston, TX (US)

(72) Inventors: Garrett T. Olsen, The Woodlands, TX (US); Grant O. Cook, III, Spring, TX (US); Daniel Brendan Voglewede, Spring, TX (US); Jeffrey G. Thomas, Magnolia, TX (US)

(73) Assignee: Halliburton Energy Service, Inc., Houston, TX (US)

( * ) Notice: Subject to any disclaimer, the term of this patent is extended or adjusted under 35 U.S.C. 154(b) by 138 days.

(21) Appl. No.: 15/112,002

(22) PCT Filed: Feb. 29, 2016

(86) PCT No.: PCT/US2016/020077

§ 371 (c)(1),
(2) Date: Jul. 15, 2016

(87) PCT Pub. No.: WO2016/153733

PCT Pub. Date: Sep. 29, 2016

(65) Prior Publication Data

US 2017/0044647 A1 Feb. 16, 2017

Related U.S. Application Data

(60) Provisional application No. 62/135,817, filed on Mar. 20, 2015.

(51) Int. Cl.
*E21B 10/46* (2006.01)
*C22C 32/00* (2006.01)
(Continued)

(52) U.S. Cl.
CPC ..... *C22C 32/0052* (2013.01); *B22F 1/0059* (2013.01); *B22F 7/06* (2013.01);
(Continued)

(58) Field of Classification Search
CPC ..... C22C 32/0052; C22C 32/00; C22C 26/00; B22F 7/06; B22F 2005/001; E21B 10/46; E21B 10/54
See application file for complete search history.

(56) References Cited

U.S. PATENT DOCUMENTS 5,662,183 A 9/1997 Fang
8,486,541 B2 7/2013 Brent et al.
(Continued)

FOREIGN PATENT DOCUMENTS

CN 101379206 A 3/2009
CN 102400028 A 4/2012
(Continued)

OTHER PUBLICATIONS

ISR/WO for PCT/US2016/020077 dated Jun. 8, 2016.

*Primary Examiner* — D. Andrews
*Assistant Examiner* — Yanick A Akaragwe
(74) *Attorney, Agent, or Firm* — Alan Bryson; C. Tumey Law Group PLLC

(57) ABSTRACT

A metal matrix composite tool that includes a hard composite portion comprising a reinforcement material infiltrated with a binder material, wherein the reinforcement material comprises a refractory metal component dispersed with reinforcing particles, wherein a surface roughness of the reinforcing particles is at least two times greater than the refractory metal component, wherein the refractory metal component has a failure strain of at least 0.05 and a shear modulus of 200 GPa or less, and wherein the reinforcing particles have a failure strain of 0.01 or less but at least five
(Continued)

times less than the failure strain of the refractory metal component, and the reinforcing particles have a shear modulus of greater than 200 GPa and at least two times greater than the shear modulus of the refractory metal component. The reinforcing particles may comprise an intermetallic, a boride, a carbide, a nitride, an oxide, a ceramic, and/or a diamond.

20 Claims, 8 Drawing Sheets

(51) Int. Cl.

| | |
|---|---|
| ***B22F 7/06*** | (2006.01) |
| ***C22C 1/10*** | (2006.01) |
| ***C22C 26/00*** | (2006.01) |
| ***B22F 1/00*** | (2006.01) |
| *B22F 5/00* | (2006.01) |
| *E21B 10/54* | (2006.01) |

(52) U.S. Cl.
CPC ..... *C22C 1/1036* (2013.01); *C22C 26/00* (2013.01); *C22C 32/00* (2013.01); *E21B 10/46* (2013.01); *B22F 2005/001* (2013.01); *B22F 2301/20* (2013.01); *B22F 2302/10* (2013.01); *B22F 2999/00* (2013.01); *E21B 10/54* (2013.01)

(56) References Cited

U.S. PATENT DOCUMENTS

| | | | | |
|---|---|---|---|---|
| 8,839,887 | B2 | 9/2014 | Xia et al. | |
| 8,852,751 | B2 | 10/2014 | Smith et al. | |
| 8,925,654 | B2 | 1/2015 | Zahradnik | |
| 8,936,750 | B2 | 1/2015 | Fang et al. | |
| 8,936,751 | B2 | 1/2015 | Lee | |
| 2013/0092450 | A1* | 4/2013 | Sreshta | B24D 3/06 175/425 |
| 2013/0255368 | A1* | 10/2013 | Harrison | E21B 49/081 73/152.18 |

FOREIGN PATENT DOCUMENTS

| | | | |
|---|---|---|---|
| CN | 102498224 | A | 6/2012 |
| JP | S 52-135805 | A | 11/1977 |
| WO | 2015/000760 | | 1/2015 |

* cited by examiner

METAL-MATRIX COMPOSITES REINFORCED WITH A REFRACTORY METAL

CROSS-REFERENCE TO RELATED APPLICATIONS

The present application is related to and claims priority to U.S. Provisional Patent App. Ser. No. 62/135,817 filed on Mar. 20, 2015.

BACKGROUND

A wide variety of tools are commonly used in the oil and gas industry for forming wellbores, in completing drilled wellbores, and in producing hydrocarbons from completed wellbores. Examples of such tools include cutting tools, such as drill bits, mills, and borehole reamers. These downhole tools, and several other types of tools outside the realm of the oil and gas industry, are often formed as metal matrix composites (MMCs) and frequently referred to as "MMC tools."

An MMC tool is typically manufactured by depositing matrix reinforcement material into a mold and, more particularly, into a mold cavity defined within the mold and designed to form various external and internal features of the MMC tool. Interior surfaces of the mold cavity, for example, may be shaped to form desired external features of the MMC tool, and temporary displacement materials, such as consolidated sand or graphite, may be positioned within interior portions of the mold cavity to form various internal (or external) features of the MMC tool. A metered amount of binder material is then added to the mold cavity and the mold is then placed within a furnace to liquefy the binder material and thereby allow the binder material to infiltrate the reinforcing particles of the matrix reinforcement material.

MMC tools are generally manufactured to be erosion-resistant and exhibit high impact strength. However, depending on the particular materials used, MMC tools can also be brittle and, as a result, stress cracks can occur as a result of thermal stress experienced during manufacturing or operation, or as a result of mechanical stress experienced during operation.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

Figure 1:
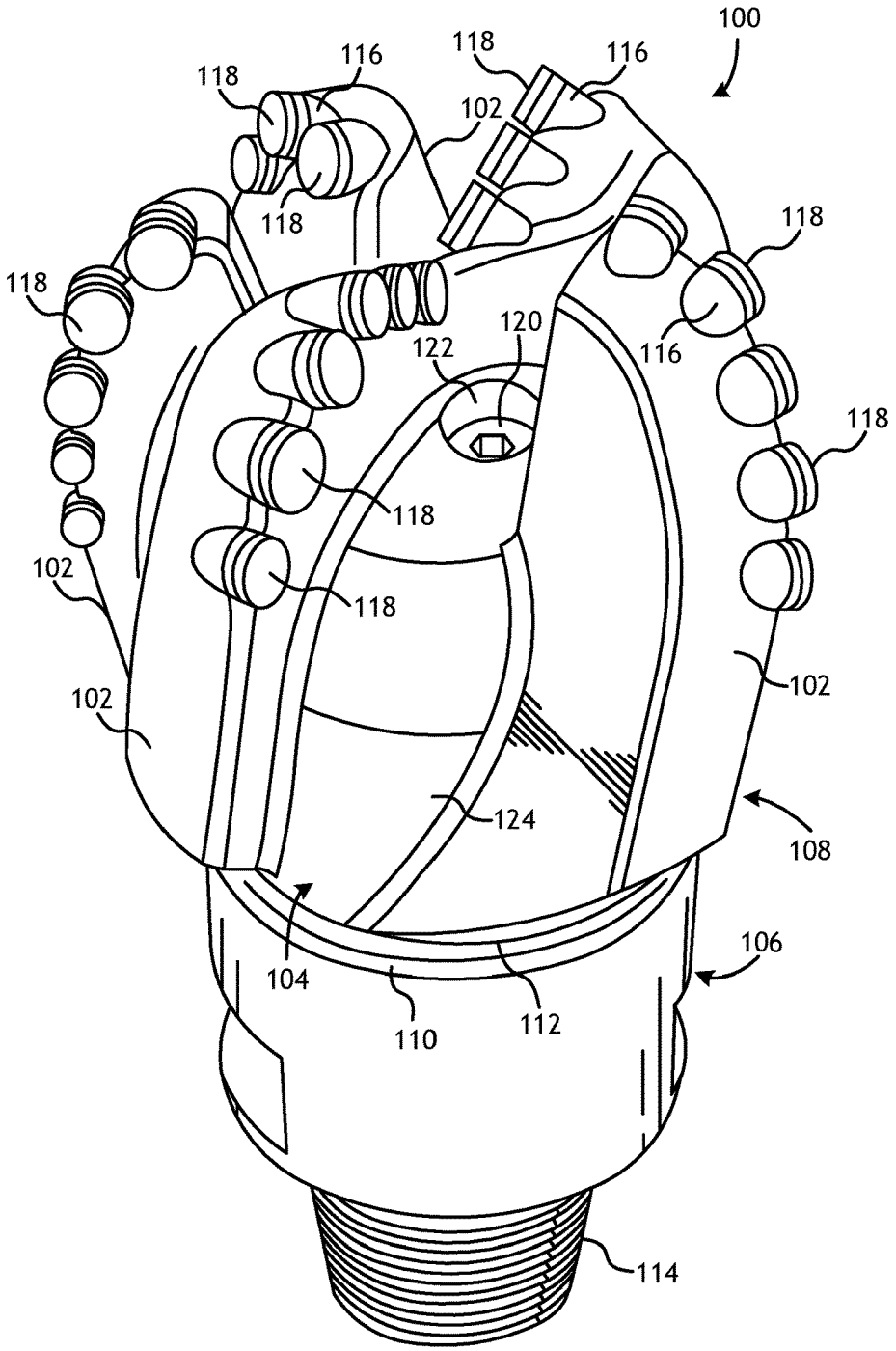
FIG. 1 is a perspective view of an exemplary drill bit that may be fabricated in accordance with the principles of the present disclosure.

The present disclosure relates to tool manufacturing and, more particularly, to metal matrix composite tools reinforced with refractory metal materials and associated methods of production and use related thereto.

Embodiments of the present disclosure describe the formation of a hard composite portion for a metal matrix composite tool, where the hard composite portion includes a reinforcement material that includes reinforcing particles dispersed with a refractory metal component. The strength, ductility, toughness, and erosion-resistance of the metal matrix composite tools may be improved by incorporating an amount of the refractory metal component into the reinforcement material. Moreover, the addition of the refractory metal component to the reinforcement material can potentially add significant strength and ductility to the metal matrix composite tool and possibly improve erosion resistance.

Embodiments of the present disclosure are applicable to any tool, part, or component formed as a metal matrix composite (MMC). For instance, the principles of the present disclosure may be applied to the fabrication of tools or parts commonly used in the oil and gas industry for the exploration and recovery of hydrocarbons. Such tools and parts include, but are not limited to, oilfield drill bits or cutting tools (e.g., fixed-angle drill bits, roller-cone drill bits, coring drill bits, bi-center drill bits, impregnated drill bits, reamers, stabilizers, hole openers, cutters), non-retrievable drilling components, aluminum drill bit bodies associated with casing drilling of wellbores, drill-string stabilizers, cones for roller-cone drill bits, models for forging dies used to fabricate support arms for roller-cone drill bits, arms for fixed reamers, arms for expandable reamers, internal components associated with expandable reamers, sleeves attached to an uphole end of a rotary drill bit, rotary steering tools, logging-while-drilling tools, measurement-while-drilling tools, side-wall coring tools, fishing spears, wash-over tools, rotors, stators and/or housings for downhole drilling motors, blades and housings for downhole turbines, and other downhole tools having complex configurations and/or asymmetric geometries associated with forming a wellbore.

The principles of the present disclosure, however, may be equally applicable to any type of MMC used in any industry or field. For instance, the methods described herein may also be applied to fabricating armor plating, automotive components (e.g., sleeves, cylinder liners, driveshafts, exhaust valves, brake rotors), bicycle frames, brake fins, wear pads, aerospace components (e.g., landing-gear components, structural tubes, struts, shafts, links, ducts, waveguides, guide vanes, rotor-blade sleeves, ventral fins, actuators, exhaust structures, cases, frames, fuel nozzles), turbopump and compressor components, a screen, a filter, and a porous catalyst, without departing from the scope of the disclosure. Those skilled in the art will readily appreciate that the foregoing list is not a comprehensive listing, but only exemplary. Accordingly, the foregoing listing of parts and/or components should not be limiting to the scope of the present disclosure.

Referring to FIG. 1, illustrated is a perspective view of an example MMC tool 100 that may be fabricated in accordance with the principles of the present disclosure. The MMC tool 100 is generally depicted in FIG. 1 as a fixed-cutter drill bit that may be used in the oil and gas industry to drill wellbores. Accordingly, the MMC tool 100 will be referred to herein as the "drill bit 100," but as indicated above, the drill bit 100 may alternatively be replaced with any type of MMC tool or part used in the oil and gas industry or any other industry, without departing from the scope of the disclosure.

As illustrated in FIG. 1, the drill bit 100 may provide a plurality of cutter blades 102 angularly spaced from each other about the circumference of a bit head 104. The bit head 104 is connected to a shank 106 to form a bit body 108. The shank 106 may be connected to the bit head 104 by welding, such as through laser arc welding that results in the formation of a weld 110 around a weld groove 112. The shank 106 may further include a threaded pin 114, such as an American Petroleum Institute (API) drill pipe thread used to connect the drill bit 100 to drill pipe (not shown).

In the depicted example, the drill bit 100 includes five cutter blades 102 in which multiple recesses or pockets 116 are formed. A cutting element 118 (alternately referred to as a "cutter") may be fixedly installed within each recess 116. This can be done, for example, by brazing each cutting element 118 into a corresponding recess 116. As the drill bit 100 is rotated in use, the cutting elements 118 engage the rock and underlying earthen materials, to dig, scrape or grind away the material of the formation being penetrated.

During drilling operations, drilling fluid or "mud" can be pumped downhole through a string of drill pipe (not shown) coupled to the drill bit 100 at the threaded pin 114. The drilling fluid circulates through and out of the drill bit 100 at one or more nozzles 120 positioned in nozzle openings 122 defined in the bit head 104. Junk slots 124 are formed between each angularly adjacent pair of cutter blades 102. Cuttings, downhole debris, formation fluids, drilling fluid, etc. may flow through the junk slots 124 and circulate back to the well surface within an annulus formed between exterior portions of the string of drill pipe and the inner wall of the wellbore being drilled.

Figure 2:
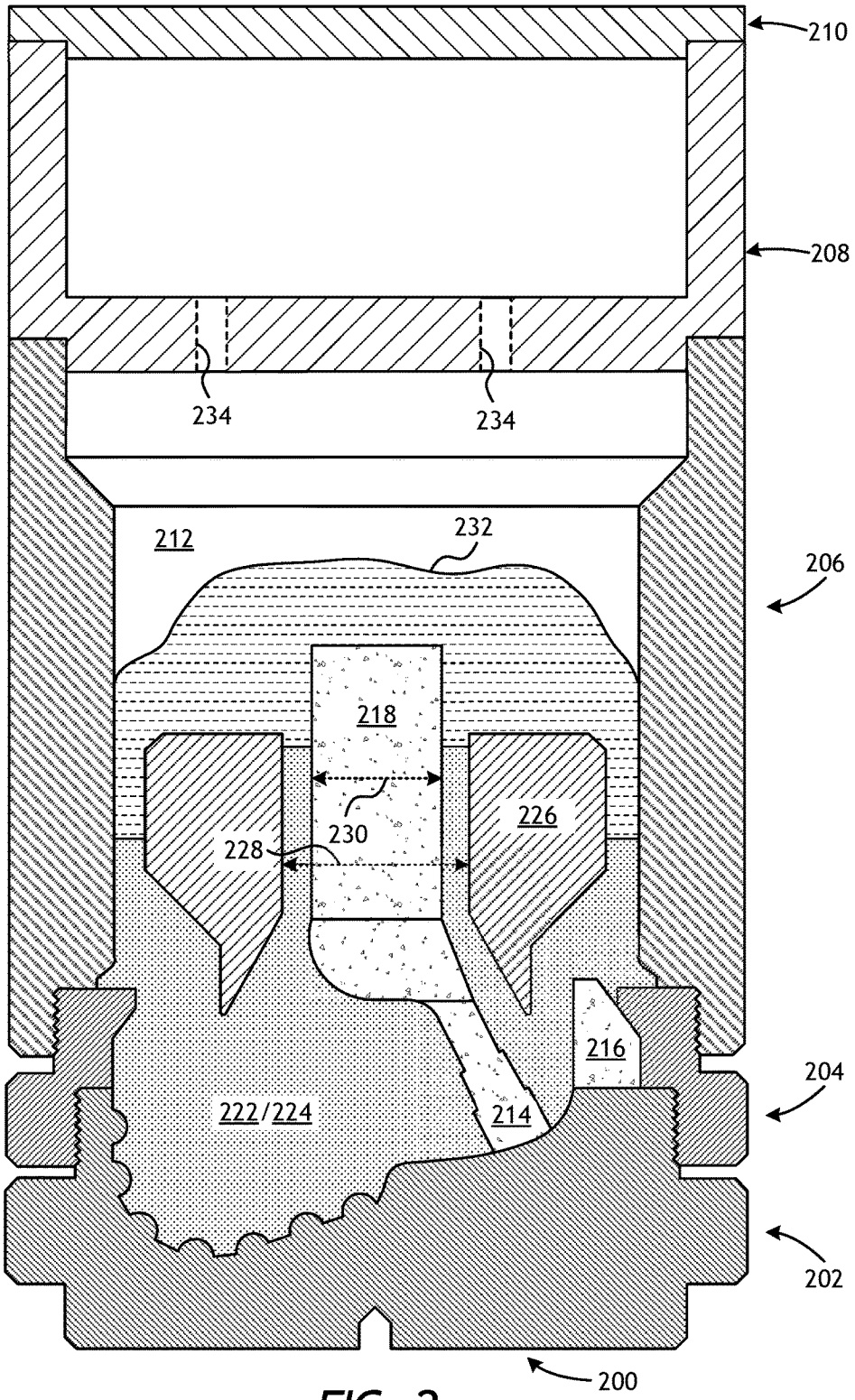
FIG. 2 is a cross-sectional side view of an exemplary mold assembly used to form the drill bit of FIG. 1.

FIG. 2 is a cross-sectional side view of a mold assembly 200 that may be used to form the drill bit 100 of FIG. 1. While the mold assembly 200 is shown and discussed as being used to help fabricate the drill bit 100, a variety of variations of the mold assembly 200 may be used to fabricate any of the MMC tools mentioned above, without departing from the scope of the disclosure. As illustrated, the mold assembly 200 may include several components such as a mold 202, a gauge ring 204, and a funnel 206. In some embodiments, the funnel 206 may be operatively coupled to the mold 202 via the gauge ring 204, such as by corresponding threaded engagements, as illustrated. In other embodiments, the gauge ring 204 may be omitted from the mold assembly 200 and the funnel 206 may instead be operatively coupled directly to the mold 202, such as via a corresponding threaded engagement, without departing from the scope of the disclosure.

In some embodiments, as illustrated, the mold assembly 200 may further include a binder bowl 208 and a cap 210 placed above the funnel 206. The mold 202, the gauge ring 204, the funnel 206, the binder bowl 208, and the cap 210 may each be made of or otherwise comprise graphite or alumina ($Al_2O_3$), for example, or other suitable materials. An infiltration chamber 212 may be defined within the mold assembly 200. Various techniques may be used to manufacture the mold assembly 200 and its components including, but not limited to, machining graphite blanks to produce the various components and thereby define the infiltration chamber 212 to exhibit a negative or reverse profile of desired exterior features of the drill bit 100 (FIG. 1).

Materials, such as consolidated sand or graphite, may be positioned within the mold assembly 200 at desired locations to form various features of the drill bit 100 (FIG. 1). For example, one or more nozzle or leg displacements 214 (one shown) may be positioned to correspond with desired locations and configurations of flow passageways defined through the drill bit 100 and their respective nozzle openings (i.e., the nozzle openings 122 of FIG. 1). One or more junk slot displacements 216 may also be positioned within the mold assembly 200 to correspond with the junk slots 124 (FIG. 1). Moreover, a cylindrically shaped central displacement 218 may be placed on the leg displacements 214. The number of leg displacements 214 extending from the central displacement 218 will depend upon the desired number of flow passageways and corresponding nozzle openings 122 in the drill bit 100. Further, cutter-pocket displacements 220 may be defined in the mold 202 or included therewith to form the cutter pockets 116 (FIG. 1). In the illustrated embodiment, the cutter-pocket displacements 220 are shown as forming an integral part of the mold 202.

After the desired displacement materials have been installed within the mold assembly 300, a reinforcement material that includes reinforcing particles 222 dispersed with a refractory metal component 224 may then be placed within or otherwise introduced into the mold assembly 300. As used herein, the term "disperse" can refer to a homogeneous or a heterogeneous mixture or combination of two or more material, which in this example is the reinforcing particles 222 and the refractory metal component 224. The mixture of the reinforcing particles 222 and the refractory metal component 224 results in a custom reinforcement material that may prove advantageous in adding strength and ductility to the resulting drill bit 100 (FIG. 1) and may also improve erosion resistance.

In some embodiments, a mandrel 226 (alternately referred to as a "metal blank") may be supported at least partially by the reinforcing particles 222 and the refractory metal component 224 within the infiltration chamber 212. More particularly, after a sufficient volume of the reinforcing particles 222 and the refractory metal component 224 has been added to the mold assembly 200, the mandrel 226 may be situated within mold assembly 200. The mandrel 226 may include an inside diameter 228 that is greater than an outside diameter 230 of the central displacement 218, and various fixtures (not expressly shown) may be used to properly position the mandrel 226 within the mold assembly 200 at a desired location. The blend of the reinforcing particles 222 and the refractory metal component 224 may then be filled to a desired level within the infiltration chamber 212 around the mandrel and the central displacement 218.

A binder material 232 may then be placed on top of the mixture of the reinforcing particles 222 and the refractory metal component 224, the mandrel 226, and the central displacement 218. In some embodiments, the binder material 232 may be covered with a flux layer (not expressly shown). The amount of binder material 232 (and optional flux material) added to the infiltration chamber 212 should be at least enough to infiltrate the reinforcing particles 222 and the refractory metal component 224 during the infiltration process. In some instances, some or all of the binder material 232 may be placed in the binder bowl 208, which may be used to distribute the binder material 232 into the infiltration chamber 212 via various conduits 234 that extend therethrough. The cap 210 (if used) may then be placed over the mold assembly 200.

The mold assembly 200 and the materials disposed therein may then be preheated and subsequently placed in a furnace (not shown). When the furnace temperature reaches the melting point of the binder material 232, the binder material 232 will liquefy and proceed to infiltrate the reinforcing particles 222 and the refractory metal component 224. After a predetermined amount of time allotted for the liquefied binder material 232 to infiltrate the reinforcing particles 222 and the refractory metal component 224, the mold assembly 200 may then be removed from the furnace and cooled at a controlled rate.

Figure 3:
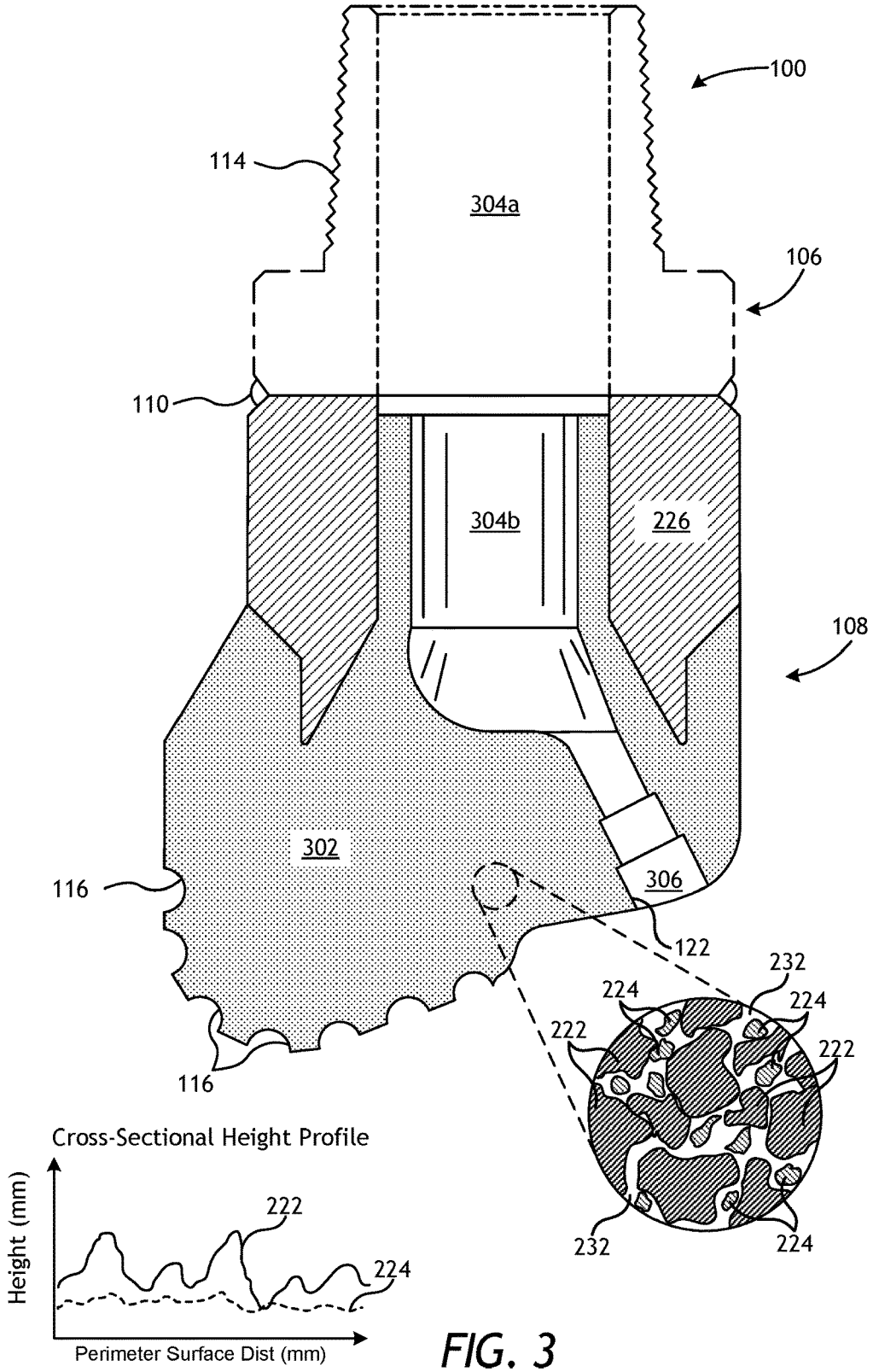
FIG. 3 is a cross-sectional view of the drill bit of FIG. 1.

FIG. 3 is a cross-sectional side view of the drill bit 100 of FIG. 1 following the above-described infiltration process within the mold assembly 200 of FIG. 2. Similar numerals from FIG. 1 that are used in FIG. 3 refer to similar components or elements that will not be described again. Once cooled, the mold assembly 200 of FIG. 2 may be broken away to expose the bit body 108, which now includes a hard composite portion 302.

As illustrated, the shank 106 may be securely attached to the mandrel 226 at the weld 110 and the mandrel 226 extends into and forms part of the bit body 108. The shank 106 defines a first fluid cavity 304*a* that fluidly communicates with a second fluid cavity 304*b* corresponding to the location of the central displacement 218 (FIG. 2). The second fluid cavity 304*b* extends longitudinally into the bit body 108, and at least one flow passageway 306 (one shown) may extend from the second fluid cavity 304*b* to exterior portions of the bit body 108. The flow passageway(s) 306 correspond to the location of the leg displacement(s) 214 (FIG. 2). The nozzle openings 122 (one shown in FIG. 3) are defined at the ends of the flow passageway(s) 306 at the exterior portions of the bit body 108, and the pockets 116 are depicted as being formed about the periphery of the bit body 108 and are shaped to receive the cutting elements 118 (FIG. 1).

As shown in the enlarged detail view of FIG. 3, the hard composite portion 302 may comprise the reinforcing particles 222 having the refractory metal component 224 dispersed therewith and infiltrated with the binder material 232. The finished bit body 108, therefore, contains a volume of refractory metal-reinforced material, which may prove advantageous in improving material strength, preventing crack propagation, and/or increasing capacity for strain energy absorption (i.e., higher toughness). Also, the addition of the refractory metal component 224 may prove advantageous in facilitating easier machining, grinding, and finishing of the infiltrated metal matrix composite material or tool.

Examples of suitable binder materials 232 used to infiltrate the reinforcing particles 222 and the refractory metal component 224 include, but are not limited to, copper, nickel, cobalt, iron, aluminum, molybdenum, chromium, manganese, tin, zinc, lead, silicon, tungsten, boron, phosphorous, gold, silver, palladium, indium, any mixture thereof, any alloy thereof, and any combination thereof. Non-limiting examples of the binder material 232 may include copper-phosphorus, copper-phosphorous-silver, copper-manganese-phosphorous, copper-nickel, copper-manganese-nickel, copper-manganese-zinc, copper-manganese-nickel-zinc, copper-nickel-indium, copper-tin-manganese-nickel, copper-tin-manganese-nickel-iron, gold-nickel, gold-palladium-nickel, gold-copper-nickel, silver-copper-zinc-nickel, silver-manganese, silver-copper-zinc-cadmium, silver-copper-tin, cobalt-silicon-chromium-nickel-tungsten, cobalt-silicon-chromium-nickel-tungsten-boron, manganese-nickel-cobalt-boron, nickel-silicon-chromium, nickel-chromium-silicon-manganese, nickel-chromium-silicon, nickel-silicon-boron, nickel-silicon-chromium-boron-iron, nickel-phosphorus, nickel-manganese, copper-aluminum, copper-aluminum-nickel, copper-aluminum-nickel-iron, copper-aluminum-nickel-zinc-tin-iron, and the like, and any combination thereof. Examples of commercially-available binder materials 232 include, but are not limited to, VIRGIN™ Binder 453D (copper-manganese-nickel-zinc, available from Belmont Metals, Inc.), and copper-tin-manganese-nickel and copper-tin-manganese-nickel-iron grades 516, 519, 523, 512, 518, and 520 available from ATI Firth Sterling.

The reinforcing particles 222 and the refractory metal component 224 may be distinguished by physical properties like failure strain, shear modulus, and solidus temperature. These physical property distinctions may provide for the improved strength, ductility, and erosion resistance of the resulting drill bit 100.

As used herein, the term "failure strain" refers to the strain reached by a material at ultimate failure, which may be determined by tensile testing according to ASTM E8-15a for the refractory metal component 224 or ASTM C1273-15 for the reinforcing particles 222. The reinforcing particles 222 may have a failure strain of 0.01 or less (e.g., 0.001 to 0.01, 0.005 to 0.01, or 0.001 to 0.005). The refractory metal component 224 may have a failure strain of at least 0.05 (e.g., 0.05 to 0.5, 0.1 to 0.5, or 0.05 to 0.1). In some instances, the failure strain of the reinforcing particles 222 may be at least five times less than the failure strain of the refractory metal component 224 (e.g., 5 to 100 times less, 5 to 50 time less, 5 to 25 times less, 10 to 50 times less, or 25 to 100 times less).

As used herein, the term "shear modulus" refers to the ratio of the shear force applied to a material divided by the deformation of the material under shear stress, which may be determined by ASTM E1875-13 for the refractory metal component 224 or ASTM C1259-15 for the reinforcing particles 222 using a monolithic sample for each rather than a particle. The reinforcing particles 222 may have a shear modulus of greater than 200 GPa (e.g., greater than 200 GPa to 1000 GPa, greater than 200 GPa to 600 GPa, 400 GPa to 1000 GPa, 600 GPa to 1000 GPa, or 800 GPa to 1000 GPa). The refractory metal component 224 may have a shear modulus of 200 GPa or less (e.g., 10 GPa to 200 GPa, 10 GPa to 100 GPa, or 100 GPa to 200 GPa). In some instances, the shear modulus of the reinforcing particles 222 may be at least two times greater than the shear modulus of the refractory metal components 320 (e.g., 2 to 40 times greater, 2 to 10 times greater, 5 to 25 times greater, 10 to 40 times greater, or 25 to 40 times greater).

Further, a surface roughness of the refractory metal component 224 may be smoother than the reinforcing particles 222, which may provide faster binder infiltration of the reinforcement material or tighter spacing of the reinforcement material. These advantages may result in a shorter heating or furnace cycle and more consistent strength, ductility, and erosion resistance properties in the hard composite portion 302. Surface roughness may be used as a measure of the smoothness of the individual particles of the refractory metal component 224 and the individual reinforcing particles 222. As used herein, the term "surface roughness" refers to the average peak-to-valley distance as determined by laser profilometry of the particle surfaces. Surface roughness of particles may depend on the size of the particles. In some instances, the surface roughness of the reinforcing particles 222 may be at least two times greater than (i.e., have a surface roughness at least two times greater than) the surface roughness of the refractory metal component 224 (e.g., 2 to 25 times greater, 5 to 10 times greater, or 10 to 25 times greater).

The inset bar chart shown in FIG. 3 provides an exemplary cross-sectional height profile comparison between the reinforcing particles 222 and the refractory metal component 224. More specifically, the bar chart compares the average perimeter surface height (y-axis) with the distance around the perimeter surface (x-axis). The peaks and valleys depicted in the bar chart correspond to the varying magnitude of the surface roughness as measured about the outer perimeter of the reinforcing particles 222 and the refractory metal component 224, respectively. The average peak-to-valley distance is calculated as the average peak height minus the average valley height. As can be seen in the bar chart, the reinforcing particles 222 may exhibit average peak-to-valley distances that are at least two times greater than the average peak-to-valley distance of the refractory metal component 224. This equates to the reinforcing particles 222 having a surface roughness of at least two times that of the refractory metal component.

Suitable reinforcing particles 222 include, but are not limited to, particles of intermetallics, borides, carbides, nitrides, oxides, ceramics, diamonds, and the like, or any combination thereof. More particularly, examples of reinforcing particles 222 suitable for use in conjunction with the embodiments described herein may include particles that include, but are not limited to, nitrides, silicon nitrides, boron nitrides, cubic boron nitrides, natural diamonds, synthetic diamonds, cemented carbide, spherical carbides, low-alloy sintered materials, cast carbides, silicon carbides, boron carbides, cubic boron carbides, molybdenum carbides, titanium carbides, tantalum carbides, niobium carbides, chromium carbides, vanadium carbides, iron carbides, tungsten carbide (e.g., macrocrystalline tungsten carbide, cast tungsten carbide, crushed sintered tungsten carbide, carburized tungsten carbide, etc.), any mixture thereof, and any combination thereof. In some embodiments, the reinforcing particles 222 may be coated. For example, by way of non-limiting example, the reinforcing particles 222 may comprise diamond coated with titanium.

In some embodiments, the reinforcing particles 222 described herein may have a diameter ranging from a lower limit of 1 micron, 10 microns, 50 microns, or 100 microns to an upper limit of 1000 microns, 800 microns, 500 microns, 400 microns, or 200 microns, wherein the diameter of the reinforcing particles 222 may range from any lower limit to any upper limit and encompasses any subset therebetween.

While any of the reinforcing particles 222 mentioned herein may be suitable for use in the reinforcement material (e.g., particles of intermetallics, borides, carbides, nitrides, oxides, ceramics, diamonds, etc.), one common type of reinforcing particle 222 is a tungsten carbide (WC) powder. However, WC, like carbide materials in general, can be hard and brittle. As such, it is sensitive to defects and prone to catastrophic failure. Strength metrics for hard materials, such as WC, are highly statistical in preventing such failures, and carbide size and quality can also dramatically impact the performance of an MMC tool.

The strength, ductility, toughness, and erosion-resistance of the hard composite portion 302 of the resulting drill bit 100, or any of the MMC tools mentioned herein, may be improved and made more repeatable by incorporating or dispersing an amount of the refractory metal component 224 into the reinforcement material. The refractory metal component 224 may comprise a refractory metal as powder, particulate, shot, or a combination of any of the foregoing. As used herein, the term "shot" refers to particles having a diameter greater than 4 mm (e.g., greater than 4 mm to 16 mm). As used herein, the term "particulate" refers to particles having a diameter of 250 microns to 4 mm. As used herein, the term "powder" refers to particles having a diameter less than 250 microns (e.g., 0.5 microns to less than 250 microns).

In some embodiments, the refractory metal component 224 described herein may have a diameter ranging from a lower limit of 1 micron, 10 microns, 50 microns, or 100 microns to an upper limit of 16 mm, 10 mm, 5 mm, 1 mm 500 microns, or 250 microns, wherein the diameter of the refractory metal component 224 may range from any lower limit to any upper limit and encompasses any subset therebetween.

The refractory metal component 224 may comprise a refractory metal, a refractory metal alloy, or a combination of a refractory metal and a refractory metal alloy. Suitable refractory metals and refractory metal alloys include those with a solidus temperature greater than the infiltration processing temperature, which may be around 1500° F., 2000° F., 2500° F., or 3000° F., or any subset or range falling therebetween. Example refractory metals that may be used as the refractory metal component 224 may be grouped into sets corresponding to the required infiltration processing temperature. Refractory metals that have a solidus temperature above 3000° F., for example, include tungsten, rhenium, osmium, tantalum, molybdenum, niobium, iridium, ruthenium, hafnium, boron, rhodium, vanadium, chromium, zirconium, platinum, titanium, and lutetium.

Example refractory metal alloys that may be used as the refractory metal component 224 include alloys of the aforementioned refractory metals, such as tantalum-tungsten, tantalum-tungsten-molybdenum, tantalum-tungsten-rhenium, tantalum-tungsten-molybdenum-rhenium, tantalum-tungsten-zirconium, tungsten-rhenium, tungsten-molybdenum, tungsten-rhenium-molybdenum, tungsten-molybdenum-hafnium, tungsten-molybdenum-zirconium, tungsten-ruthenium, niobium-vanadium, niobium-vanadium-titanium, niobium-zirconium, niobium-tungsten-zirconium, niobium-hafnium-titanium, and niobium-tungsten-hafnium. Additionally, example refractory metal alloys include alloys wherein any of the aforementioned refractory metals is the most prevalent element in the alloy. Examples for tungsten-based alloys where tungsten is the most prevalent element in the alloy include tungsten-copper, tungsten-nickel-copper, tungsten-nickel-iron, tungsten-nickel-copper-iron, and tungsten-nickel-iron-molybdenum.

Refractory metals that have a solidus temperature above 2500° F. include the refractory metals listed previously in addition to palladium, thulium, scandium, iron, yttrium, erbium, cobalt, holmium, nickel, silicon, and dysprosium. Example refractory metal alloys include alloys of the aforementioned refractory metals having a solidus temperature above 2500° F. and the refractory metals having a solidus temperature above 3000° F. Example nickel-based alloys include nickel alloyed with vanadium, chromium, molybdenum, tantalum, tungsten, rhenium, osmium, or iridium. Additionally, example refractory metal-based alloys include alloys wherein any of the aforementioned refractory metals is the most prevalent element in the alloy. Examples for nickel-based alloys where nickel is the most prevalent element in the alloy include nickel-copper, nickel-chromium, nickel-chromium-iron, nickel-chromium-molybdenum, nickel-molybdenum, HASTELLOY® alloys (i.e., nickel-chromium containing alloys, available from Haynes International), INCONEL® alloys (i.e., austenitic nickel-chromium containing superalloys available from Special Metals Corporation), WASPALOYS® (i.e., austenitic nickel-based superalloys), RENE® alloys (i.e., nickel-chromium containing alloys available from Altemp Alloys, Inc.), HAYNES® alloys (i.e., nickel-chromium containing superalloys available from Haynes International), MP98T (i.e., a nickel-copper-chromium superalloy available from SPS Technologies), TMS alloys, CMSX® alloys (i.e., nickel-based superalloys available from C-M Group). Example iron-based alloys include steels, stainless steels, carbon steels, austenitic steels, ferritic steels, martensitic steels, precipitation-hardening steels, duplex stainless steels, and hypo-eutectoid steels.

Refractory metals that have a solidus temperature above 2000° F. include the refractory metals listed previously in addition to terbium, gadolinium, beryllium, manganese, and uranium. Example refractory metal-based alloys include alloys comprised of the aforementioned refractory metals having a solidus temperature above 2000° F. and the refractory metals having a solidus temperature above 2500° and 3000° F. Additionally, example refractory metal-based alloys include alloys wherein any of the aforementioned refractory metals having a solidus temperature above 2000° F. is the most prevalent element in the alloy. Example alloys include INCOLOY® alloys (i.e., iron-nickel containing superalloys available from Mega Mex) and hyper-eutectoid steels.

Refractory metals that have a solidus temperature above 1500° F. include the refractory metals listed previously in addition to copper, samarium, gold, neodymium, silver, germanium, praseodymium, lanthanum, calcium, europium, and ytterbium. Example refractory metal-based alloys include alloys comprised of the aforementioned refractory metals having a solidus temperature above 1500° F. and the refractory metals listed previously having a solidus temperature above 2000° F., 2500° and 3000° F. Additionally, example refractory metal-based alloys include alloys wherein any of the aforementioned refractory metals having a solidus temperature above 1500° F. is the most prevalent element in the alloy.

The refractory metal component 224 may be dispersed with the reinforcing particles 222 to produce the reinforcement material by mixing, blending, or otherwise combining the refractory metal component 224 with the reinforcing particles 222. In some cases, the refractory metal component 224 may be dispersed in the reinforcement material by mixing in agglomerations of the reinforcing particles 222 and/or the refractory metal component 224. In other cases, the refractory metal component 224 may be dispersed in the reinforcement material by loading one material above the other (in layers) and subsequently tapping, tamping, vibrating, shaking, etc. to produce a functionally graded mix of the reinforcing particles 222 and the refractory metal component 224 in-situ. In yet other cases, the refractory metal component 224 may be dispersed in the reinforcement material using organics that allow loading of the separate components without segregation, which may prove advantageous in making functional grading more controllable.

The refractory metal component 224 may be dispersed or otherwise included in the reinforcement material over a range of concentrations, depending primarily on the desired properties of the resulting hard composite portion 302 (FIG. 3). For example, the hard composite portion 302 may include the refractory metal component 224 at a concentration ranging from a lower limit of 1%, 3%, or 5% by weight of the reinforcement material of the reinforcement material to an upper limit of 40%, 30%, 20%, or 10% by weight of the reinforcement material, wherein the concentration of the refractory metal component 224 may range from any lower limit to any upper limit and encompasses any subset therebetween. To be applicable to all types of MMC tools mentioned herein, however, the hard composite portion 302 may include the refractory metal component 224 or the reinforcing particles 222 at a concentration ranging from anywhere between greater than 0% to less than 100% by weight of the reinforcement material, without departing from the scope of the disclosure.

While certain metal powders have been added to reinforcement materials as an infiltration aid, the refractory metal component 224 mixed with the reinforcing particles 222 of the present disclosure works in a fundamentally different way since the refractory metal component 224 does not melt into the continuous binder phase in the resulting MMC tool. In most cases, the refractory metal component 224 does not interdiffuse with the binder phase to an appreciable extent, thereby leaving the refractory metal component 224 to remain as ductile third-phase particles in the resulting MMC tool after the infiltration process.

In one specific embodiment, the reinforcing particles 222 may comprise tungsten carbide (WC) and the refractory metal component 224 may comprise a tungsten (W) metal powder. Using tungsten metal powder as the refractory metal component 224 may be advantageous since it is harder and less reactive than most other metals due to its hardness and corrosion resistance. As compared to the use of a softer (more ductile) metal, the tungsten metal powder provides a more rigid and repeatable spacing effect, which reduces the brittleness caused by carbides that are fused close together. As a result, this reduces the amount of ductile binder material 232 that can deform under high stresses and/or stress concentrations thereby limiting carbide fracture due to excessive matrix deformation. The mean particle size and the particle size distribution of the tungsten metal powder can be used to achieve this desired spacing between the reinforcing particles 222 (e.g., WC particles). Moreover, the lower reactivity of the binder material 232 with tungsten metal powder may mitigate the formation of potentially unwanted intermetallics that might otherwise occur with the use of other transition metals.

Figure 4:
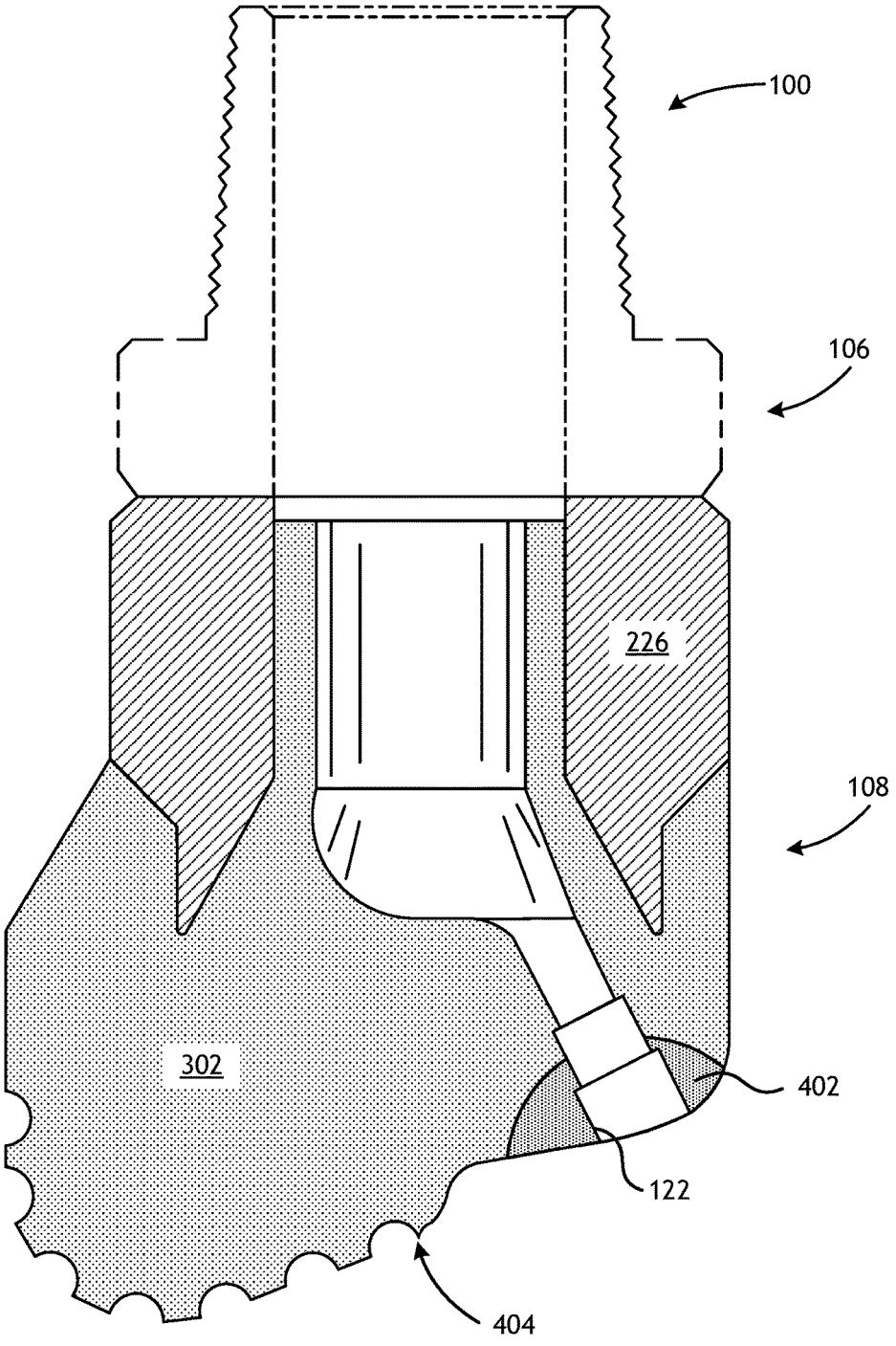
FIG. 4 illustrates a cross-sectional side view of the drill bit of FIG. 1 with one or more localized hard composite portions.
Figure 5:
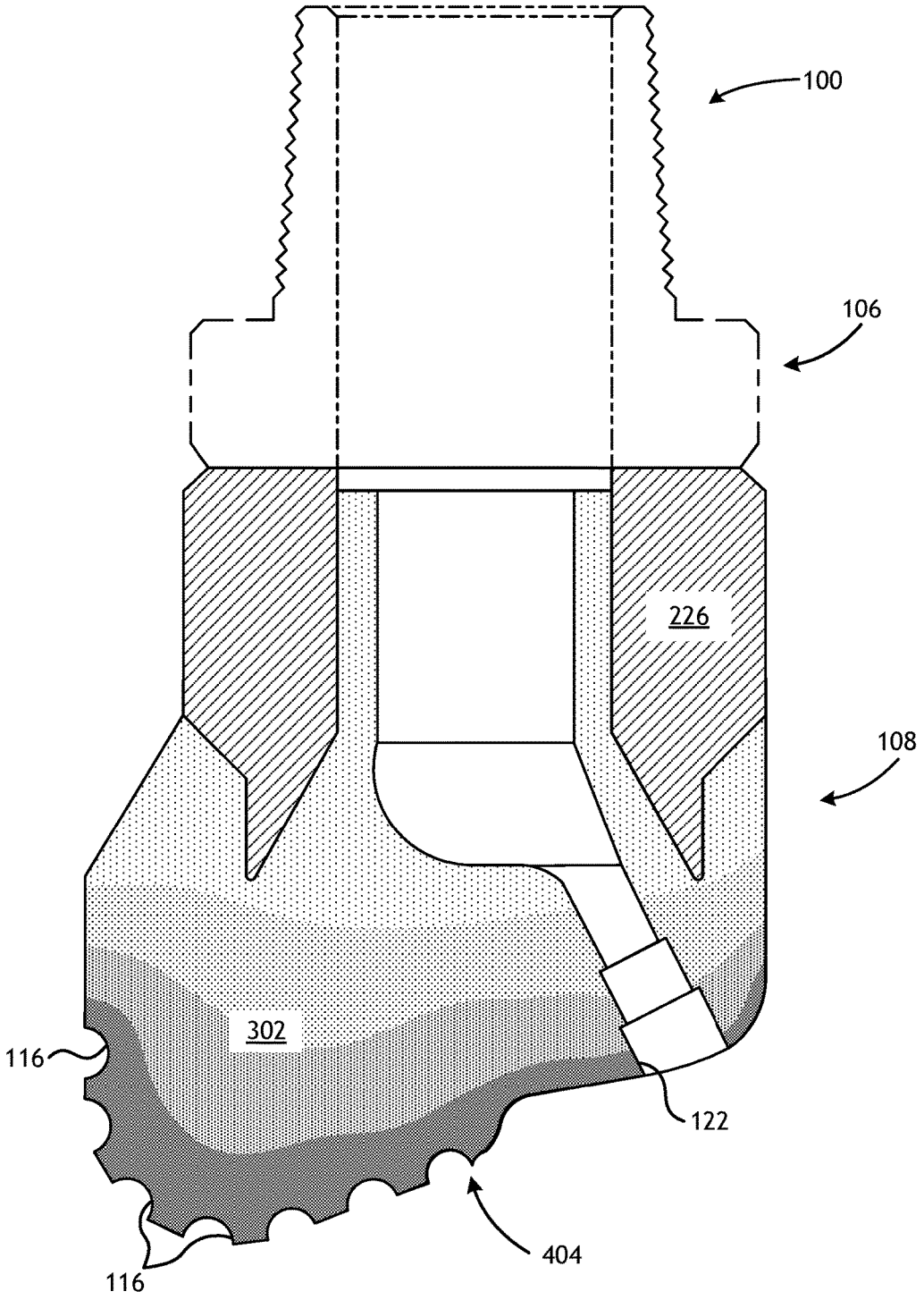
FIG. 5 illustrates a cross-sectional side view of the drill bit of FIG. 1 as comprising a varied concentration of the hard composite portion.
Figure 6:
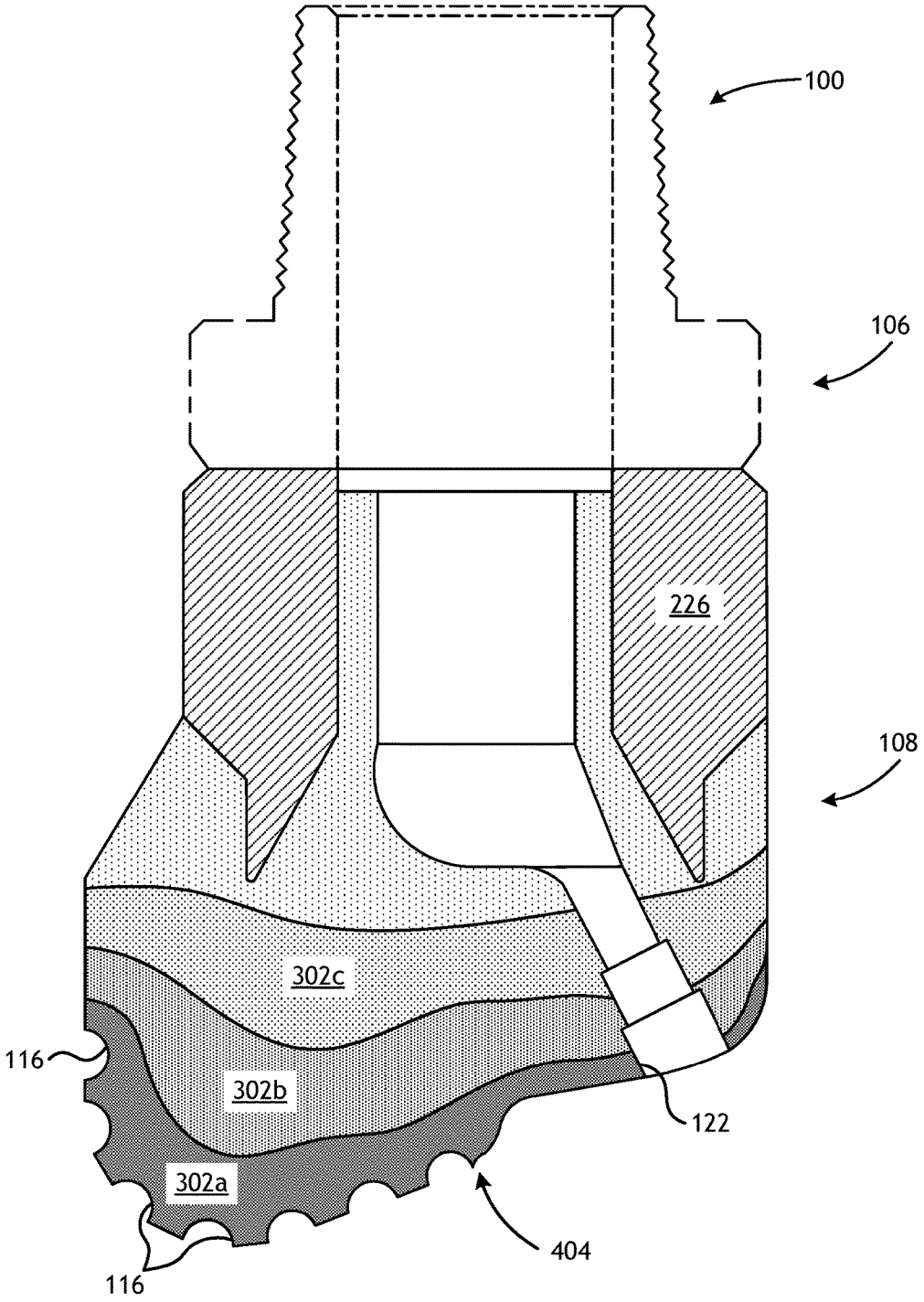
FIG. 6 illustrates a cross-sectional side view of the drill bit of FIG. 1 where the hard composite portion comprises a plurality of distinct layers of varying concentration of the refractory metal component.

By way of non-limiting illustration, FIGS. 4-6 provide examples of dispersing the refractory metal component 224 into the reinforcement material in MMC tools and, more particularly, in the drill bit 100 of FIGS. 1 and 3. One skilled in the art will recognize how to adapt these teachings to other MMC tools or portions thereof in keeping with the scope of the disclosure.

FIG. 4 illustrates a cross-sectional side view of the drill bit 100 where the bit body 108 comprises the hard composite portion 302 and one or more localized hard composite portions 402, according to one or more embodiments. The hard composite portion 302 in FIG. 4 may comprise a mixture or blend of the reinforcing particles 222 (FIG. 3) and the refractory metal component 224 (FIG. 3), where the refractory metal component 224 is included at a concentration ranging from a lower limit of 1%, 3%, or 5% by weight of the reinforcement material of the reinforcement material to an upper limit of 40%, 30%, 20%, or 10% by weight of the reinforcement material. In contrast, the localized hard composite portion 402 may comprise a mixture or blend of the reinforcing particles 222 and the refractory metal component 224, where the refractory metal component 224 is included at higher concentrations like a concentration of about 80%, about 85%, about 90%, about 95%, or 100% by weight of the reinforcement material, wherein the concentration of the refractory metal component 224 may encompass any subset therebetween. To be applicable to all types of MMC tools mentioned herein, however, the localized hard composite portion 402 may comprise a mixture or blend of the reinforcing particles 222 and the refractory metal component 224, where the reinforcing particles 222 or the refractory metal component 224 is included at a concentration ranging from anywhere between greater than 0% to less than 100% by weight of the reinforcement material, without departing from the scope of the disclosure.

As illustrated, the localized hard composite portion 402 may be localized in the bit body 108 at one or more locations with the remaining portion of the bit body 108 being formed by the hard composite portion 302. The localized hard composite portion 402 is shown in FIG. 4 as being located proximal the nozzle openings 122 and generally at an apex 404 of the drill bit 100, the two areas of the bit body 108 that typically have an increased propensity for cracking. As used herein, the term "apex" refers to the central portion of the exterior surface of the bit body 108 that engages the formation during drilling and generally at or near where the cutter blades 102 (FIG. 1) meet on the exterior surface of the bit body 108 to engage the formation during drilling. In other embodiments, the localized hard composite portion 402 may be localized in the bit body 108 at any of the interior regions, such as around and/or near the metal blank 202, or at any area of geometric transitions (e.g., blade roots, etc.). The localized hard composite portion 402 may help mitigate crack initiation and propagation, while also manipulating the erosion properties of the bit body 108 because of the lower concentration of reinforcing particles 222 at the localized areas.

FIG. 5 illustrates a cross-sectional side view of the drill bit 100 as comprising a varying concentration of the hard composite portion 302 within the bit body 108, in accordance with the teachings of the present disclosure. As shown by the degree of stippling in the bit body 108, the concentration of the refractory metal component 224 in the hard composite portion 302 may increase from the apex 404 to the shank 106 of the bit body 108. In the illustrated embodiment, the lowest concentration of the refractory metal component 224 is adjacent the nozzle openings 122 and the pockets 116 and the highest concentrations thereof are adjacent the metal blank 202.

In alternative embodiments, however, the gradient of concentration of the refractory metal component 224 can be reversed where the concentration of the refractory metal component 224 decreases from the apex 404 toward the shank 106. Moreover, while shown in FIG. 5 as varying longitudinally within the bit body 108, the gradient in the concentration of the refractory metal component 224 can alternatively be designed to vary radially or a combination of radially and vertically, without departing from the scope of the disclosure. Accordingly, the gradient of concentration of the refractory metal component 224 as dispersed within the reinforcement material may increase or decrease in any direction (i.e., radially, axially, longitudinally, laterally, circumferentially, angularly, and any combination thereof) through the drill bit 100 (or any other type of MMC tool).

In some embodiments, the concentration change of the refractory metal component 224 in the hard composite portion 302 may be gradual. In other embodiments, however, the concentration change may be more distinct and thereby resemble layering or localization. For example, FIG. 6 illustrates a cross-sectional side view of the drill bit 100 where the hard composite portion 302 comprises a plurality of distinct layers of varying concentration of the refractory metal component 224, according to one or more embodiments. More particularly, the hard composite portion 302 is depicted in FIG. 6 as comprising layers 302*a*, 302*b*, and 302*c*. The first layer 302*a* may exhibit the lowest concentration of refractory metal component 224 and is depicted as being located proximal the nozzle openings 122 and the pockets 116. The third layer 302*c* may exhibit the highest concentration of refractory metal component 224 and is depicted as being located proximal the metal blank 202. The second layer 302*b* with may exhibit a concentration of refractory metal component 224 between that of the first and third layers 302*a,c* and generally interposes said layers 302*a,c*. Alternatively, the concentration of the refractory metal component 224 in the hard composite portion layers 302*a-c* may decrease from the apex 404 toward the metal blank 202, without departing from the scope of the disclosure.

Figure 7:
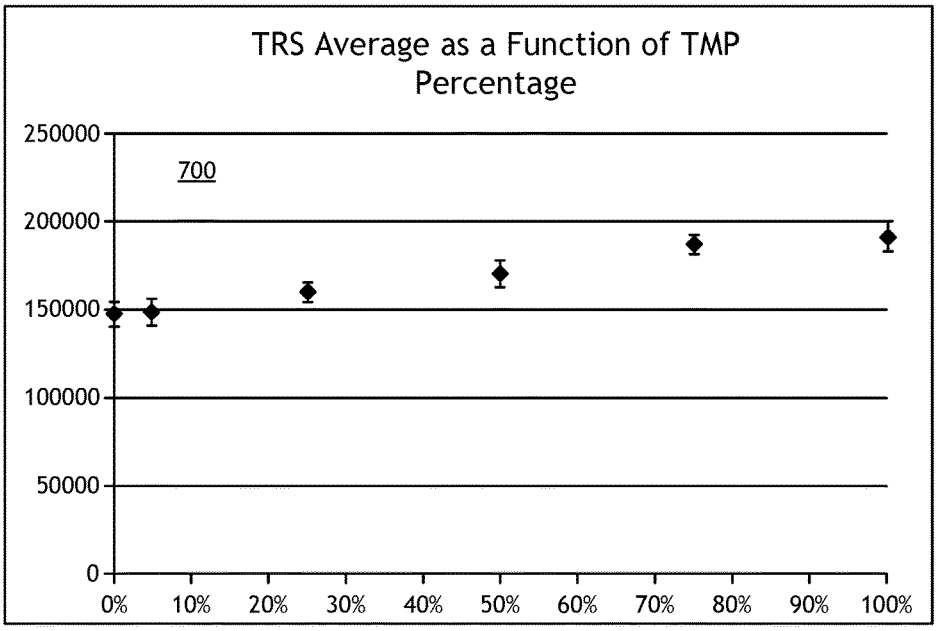
FIG. 7 is a plot that depicts measured transverse rupture strength of the hard composite portion of FIG. 2.

FIG. 7 is a plot 700 that depicts measured transverse rupture strength (TRS) of the hard composite portion 302 (FIG. 3). More particularly, the plot 700 depicts measured TRS when the hard composite portion 302 is made from a blend of tungsten carbide (WC) powder as the reinforcing particles 222 (FIG. 3) and tungsten metal powder (TMP) as the refractory metal component 224 (FIG. 3). As illustrated, the TRS of the composite WC powder and TMP increases with increasing addition of TMP. While this increase in strength is desirable, another important consideration is the erosion and abrasion properties of the final hard composite portion 302. To be of benefit in drill bits (e.g., the drill bit 100 of FIGS. 1 and 3), for example, an optimal combination of high strength and high erosion-resistance must be found. With advancements in WC powder manufacture, lower and lower erosion rates are achievable. These improved WC powders, in combination with a TMP component, is now a viable option to create tough erosion-resistance MMC materials. More particularly, in combination with localized blend concentrations as described in conjunction with FIGS. 4-6, erosion-resistance properties of certain portions of the drill bits or other types of MMC tools may be retained or optimized, while toughness of other portions of the drill bit or other types of MMC tools may be optimized to prevent, delay, or slow crack initiation and propagation during bit manufacture and/or operation.

Figure 8:
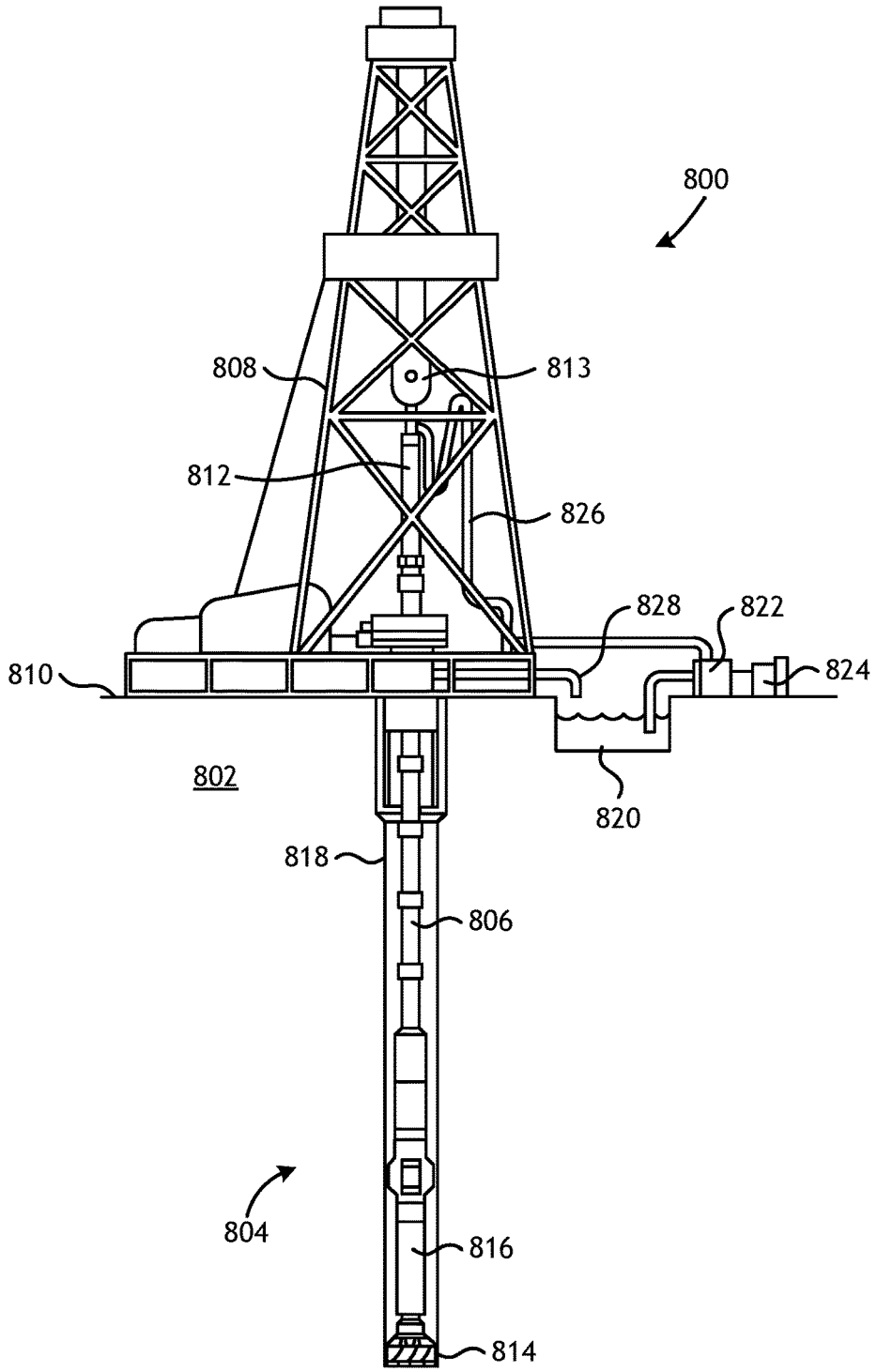
FIG. 8 is an exemplary drilling system that may employ one or more principles of the present disclosure.

FIG. 8 is a schematic of an exemplary drilling system 800 that may employ one or more principles of the present disclosure. Boreholes may be created by drilling into the earth 802 using the drilling system 800. The drilling system 800 may be configured to drive a bottom hole assembly (BHA) 804 positioned or otherwise arranged at the bottom of a drill string 806 extended into the earth 802 from a derrick 808 arranged at the surface 810. The derrick 808 includes a kelly 812 and a traveling block 813 used to lower and raise the kelly 812 and the drill string 806.

The BHA 804 may include a drill bit 814 operatively coupled to a tool string 816 which may be moved axially within a drilled wellbore 818 as attached to the drill string 806. The drill bit 814 may be fabricated and otherwise created in accordance with the principles of the present disclosure and, more particularly, with a reinforcement material that includes a refractory metal component 224 (FIG. 3) dispersed with the reinforcing particles 222 (FIG.

3). During operation, the drill bit 814 penetrates the earth 802 and thereby creates the wellbore 818. The BHA 804 provides directional control of the drill bit 814 as it advances into the earth 802. The tool string 816 can be semi-permanently mounted with various measurement tools (not shown) such as, but not limited to, measurement-while-drilling (MWD) and logging-while-drilling (LWD) tools, that may be configured to take downhole measurements of drilling conditions. In other embodiments, the measurement tools may be self-contained within the tool string 816, as shown in FIG. 8.

Fluid or "mud" from a mud tank 820 may be pumped downhole using a mud pump 822 powered by an adjacent power source, such as a prime mover or motor 824. The mud may be pumped from the mud tank 820, through a standpipe 826, which feeds the mud into the drill string 806 and conveys the same to the drill bit 814. The mud exits one or more nozzles arranged in the drill bit 814 and in the process cools the drill bit 814. After exiting the drill bit 814, the mud circulates back to the surface 810 via the annulus defined between the wellbore 818 and the drill string 806, and in the process returns drill cuttings and debris to the surface. The cuttings and mud mixture are passed through a flow line 828 and are processed such that a cleaned mud is returned down hole through the standpipe 826 once again.

Although the drilling system 800 is shown and described with respect to a rotary drill system in FIG. 8, many types of drilling systems can be employed in carrying out embodiments of the disclosure. For instance, drills and drill rigs used in embodiments of the disclosure may be used onshore or offshore. Offshore oilrigs that may be used in accordance with embodiments of the disclosure include, for example, floaters, fixed platforms, gravity-based structures, drill ships, semi-submersible platforms, jack-up drilling rigs, tension-leg platforms, and the like. Embodiments of the disclosure can be applied to rigs ranging anywhere from small in size and portable, to bulky and permanent.

Further, although described herein with respect to oil drilling, various embodiments of the disclosure may be used in many other applications. For example, disclosed methods can be used in drilling for mineral exploration, environmental investigation, natural gas extraction, underground installation, mining operations, water wells, geothermal wells, and the like. Further, embodiments of the disclosure may be used in weight-on-packers assemblies, in running liner hangers, in running completion strings, etc., without departing from the scope of the disclosure.

Embodiments disclosed herein include:

A. A metal matrix composite (MMC) tool that includes a hard composite portion that comprises a reinforcement material infiltrated with a binder material, wherein the reinforcement material comprises a refractory metal component dispersed with reinforcing particles, wherein the reinforcing particles are at least two times rougher than the refractory metal component, wherein the refractory metal component has a failure strain of at least 0.05 and a shear modulus of 200 GPa or less, and wherein the reinforcing particles have a failure strain of 0.01 or less but at least five times less than the failure strain of the refractory metal component, and the reinforcing particles have a shear modulus of greater than 200 GPa and at least two times greater than the shear modulus of the refractory metal component.

B. A drill bit that includes a bit body, and a plurality of cutting elements coupled to an exterior of the bit body, wherein at least a portion of the bit body comprises a hard composite portion that comprises a reinforcement material infiltrated with a binder material, wherein the reinforcement material comprises a refractory metal component dispersed with reinforcing particles, wherein the reinforcing particles are at least two times rougher than the refractory metal component, wherein the refractory metal component has a failure strain of at least 0.05 and a shear modulus of 200 GPa or less, and wherein the reinforcing particles have a failure strain of 0.01 or less but at least five times less than the failure strain of the refractory metal component, and the reinforcing particles have a shear modulus of greater than 200 GPa and at least two times greater than the shear modulus of the refractory metal component.

C. A drilling assembly that includes a drill string extendable from a drilling platform and into a wellbore, a drill bit attached to an end of the drill string, and a pump fluidly connected to the drill string and configured to circulate a drilling fluid to the drill bit and through the wellbore, wherein the drill bit comprises a bit body and a plurality of cutting elements coupled to an exterior of the bit body, and wherein at least a portion of the bit body comprises a hard composite portion that comprises a reinforcement material infiltrated with a binder material, wherein the reinforcement material comprises a refractory metal component dispersed with reinforcing particles, wherein the reinforcing particles are at least two times rougher than the refractory metal component, wherein the refractory metal component has a failure strain of at least 0.05 and a shear modulus of 200 GPa or less, and wherein the reinforcing particles have a failure strain of 0.01 or less but at least five times less than the failure strain of the refractory metal component, and the reinforcing particles have a shear modulus of greater than 200 GPa and at least two times greater than the shear modulus of the refractory metal component.

Each of embodiments A, B, and C may have one or more of the following additional elements in any combination: Element 1: wherein the reinforcing particles comprise particles of a material selected from the group consisting of an intermetallic, a boride, a carbide, a nitride, an oxide, a ceramic, diamond, and any combination thereof. Element 2: wherein the refractory metal component is selected from the group consisting of a refractory metal, a refractory metal alloy, and a combination of a refractory metal and a refractory metal alloy. Element 3: wherein the refractory metal component has solidus temperature greater than 1500° F. and is selected from the group consisting of tungsten, rhenium, osmium, tantalum, molybdenum, niobium, iridium, ruthenium, hafnium, boron, rhodium, vanadium, chromium, zirconium, platinum, titanium, lutetium, palladium, thulium, scandium, iron, yttrium, erbium, cobalt, holmium, nickel, silicon, dysprosium, terbium, gadolinium, beryllium, manganese, copper, samarium, gold, neodymium, silver, germanium, praseodymium, lanthanum, calcium, europium, ytterbium, and any alloy thereof. Element 4: wherein the refractory metal component is a tungsten metal powder and the reinforcing particles are a tungsten carbide powder. Element 5: wherein the hard composite portion comprises the refractory metal component at a concentration ranging from between 1% and 40% by weight of the reinforcement material. Element 6: wherein the reinforcement material is infiltrated with the binder material at a temperature greater than a liquidus temperature of the binder material but lower than a solidus temperature of the refractory metal component. Element 7: wherein the hard composite portion further comprises one or more localized hard composite portions comprising the refractory metal component dispersed with the reinforcing particles at a concentration ranging between 80% and 100% by weight of reinforcement material. Element 8: wherein a gradient of concentration of the refractory metal component progressively decreases in a direction through the hard composite portion. Element 9: wherein a gradient of concentration of the refractory metal component progressively increases in a direction through the hard composite portion. Element 10: wherein the hard composite portion comprises a plurality of distinct layers of varying concentration of the refractory metal component. Element 11: wherein the reinforcing particles are 2 to 25 times rougher than the refractory metal component. Element 12: wherein the refractory metal component has a failure strain of 0.05 to 0.5, and wherein the reinforcing particles have a failure strain of 0.001 to 0.01 but 5-100 times less than the failure strain of the refractory metal component. Element 13: wherein the refractory metal component has a shear modulus of 10 GPa to 200 GPa, and wherein the reinforcing particles have a shear modulus of greater than 200 GPa to 1000 GPa and 2 to 40 times greater than the shear modulus of the refractory metal component. Element 14: wherein the refractory metal component has an average diameter of 1 micron to 16 mm. Element 15: wherein the reinforcing particles have an average diameter of 1 micron to 1000 microns. Element 16: wherein the refractory metal component comprises a powder. Element 17: wherein the refractory metal component comprises particulates. Element 18: wherein the refractory metal component comprises shot.

By way of non-limiting example, exemplary combinations applicable to A, B, and C include: Element 2 with Element 3; two or more of Elements 14-18 in combination; Elements 5 and 7 in combination; one or more of Elements 14-18 in combination with one or more of Elements 1-2; two or more of Elements 11-13 in combination; and combinations of the foregoing.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. A metal matrix composite (MMC) tool, comprising:

a hard composite portion that comprises a reinforcement material infiltrated with a binder material, wherein the reinforcement material comprises a refractory metal component dispersed with reinforcing particles, wherein a surface roughness of the reinforcing particles is at least two times greater than a surface roughness of the refractory metal component, wherein the refractory metal component has a failure strain of at least 0.05 and a shear modulus of 200 GPa or less, and wherein the reinforcing particles have a failure strain of 0.01 or less but at least five times less than the failure strain of the refractory metal component, and the reinforcing particles have a shear modulus of greater than 200 GPa and at least two times greater than the shear modulus of the refractory metal component.

2. The MMC tool of claim 1, wherein the reinforcing particles comprise particles of a material selected from the group consisting of an intermetallic, a boride, a carbide, a nitride, an oxide, a ceramic, diamond, and any combination thereof.

3. The MMC tool of claim 1, wherein the refractory metal component is selected from the group consisting of a refractory metal, a refractory metal alloy, and a combination of a refractory metal and a refractory metal alloy.

4. The MMC tool of claim 3, wherein the refractory metal component has solidus temperature greater than 1500° F. and is selected from the group consisting of tungsten, rhenium, osmium, tantalum, molybdenum, niobium, iridium, ruthenium, hafnium, boron, rhodium, vanadium, chromium, zirconium, platinum, titanium, lutetium, palladium, thulium, scandium, iron, yttrium, erbium, cobalt, holmium, nickel, silicon, dysprosium, terbium, gadolinium, beryllium, manganese, copper, samarium, gold, neodymium, silver, germanium, praseodymium, lanthanum, calcium, europium, ytterbium, and any alloy thereof.

5. The MMC tool of claim 1, wherein the refractory metal component is a tungsten metal powder and the reinforcing particles are a tungsten carbide powder.

6. The MMC tool of claim 1, wherein the hard composite portion comprises the refractory metal component at a concentration ranging from between 1% and 40% by weight of the reinforcement material.

7. The MMC tool of claim 1, wherein the reinforcement material is infiltrated with the binder material at a temperature greater than a liquidus temperature of the binder material but lower than a solidus temperature of the refractory metal component.

8. The MMC tool of claim 1, wherein the hard composite portion further comprises one or more localized hard composite portions comprising the refractory metal component dispersed with the reinforcing particles at a concentration ranging between 80% and 100% by weight of reinforcement material.

9. The MMC tool of claim 1, wherein a gradient of concentration of the refractory metal component progressively decreases in a direction through the hard composite portion.

10. The MMC tool of claim 1, wherein the hard composite portion comprises a plurality of distinct layers of varying concentration of the refractory metal component.

11. A drill bit, comprising:

a bit body; and a plurality of cutting elements coupled to an exterior of the bit body, wherein at least a portion of the bit body comprises a hard composite portion that comprises a reinforcement material infiltrated with a binder material, wherein the reinforcement material comprises a refractory metal component dispersed with reinforcing particles, wherein a surface roughness of the reinforcing particles is at least two times greater than a surface roughness of the refractory metal component, wherein the refractory metal component has a failure strain of at least 0.05 and a shear modulus of 200 GPa or less, and wherein the reinforcing particles have a failure strain of 0.01 or less and at least five times less than the failure strain of the refractory metal component, and the reinforcing particles have a shear modulus of greater than 200 GPa and at least two times greater than the shear modulus of the refractory metal component.

12. The drill bit of claim 11, wherein the refractory metal component is selected from the group consisting of a refractory metal, a refractory metal alloy, and a combination of a refractory metal and a refractory metal alloy.

13. The drill bit of claim 11, wherein the refractory metal component is a tungsten metal powder or tungsten alloy powder and the reinforcement material is a tungsten carbide powder.

14. The drill bit of claim 11, wherein the hard composite portion comprises the refractory metal component at a concentration ranging from between 1% and 40% by weight of the reinforcement material.

15. The drill bit of claim 11, wherein the refractory metal component and the reinforcement material are infiltrated with the binder material at a temperature greater than a melting point of the binder material but lower than a solidus temperature of the refractory metal component.

16. The drill bit of claim 11, wherein the hard composite portion further comprises one or more localized hard composite portions comprising the refractory metal component dispersed with the reinforcing particles at a concentration ranging between 80% and 100% by weight of reinforcement material.

17. The drill bit of claim 11, wherein a gradient of concentration of the refractory metal component progressively decreases in a direction through the hard composite portion.

18. The drill bit of claim 11, wherein the hard composite portion comprises a plurality of distinct layers of varying concentration of the refractory metal component.

19. A drilling assembly, comprising:

a drill string extendable from a drilling platform and into a wellbore;

a drill bit attached to an end of the drill string; and a pump fluidly connected to the drill string and configured to circulate a drilling fluid to the drill bit and through the wellbore, wherein the drill bit comprises a bit body and a plurality of cutting elements coupled to an exterior of the bit body, and wherein at least a portion of the bit body comprises a hard composite portion that comprises a reinforcement material infiltrated with a binder material, wherein the reinforcement material comprises a refractory metal component dispersed with reinforcing particles, wherein a surface roughness of the reinforcing particles is at least two times greater than a surface roughness of the refractory metal component, wherein the refractory metal component has a failure strain of at least 0.05 and a shear modulus of 200 GPa or less, and wherein the reinforcing particles have a failure strain of 0.01 or less and at least five times less than the failure strain of the refractory metal component, and the reinforcing particles have a shear modulus of greater than 200 GPa and at least two times greater than the shear modulus of the refractory metal component.

20. The drilling assembly of claim 19, wherein the reinforcing particles comprise particles of a material selected from the group consisting of an intermetallic, a boride, a carbide, a nitride, an oxide, a ceramic, diamond, and any combination thereof, and wherein the refractory metal component is selected from the group consisting of a refractory metal, a refractory metal alloy, and a combination of a refractory metal and a refractory metal alloy.

* * * * *